US005285547A

United States Patent [19]

Sebor

[11] Patent Number: 5,285,547

[45] Date of Patent: Feb. 15, 1994

[54] INTERNAL BY-PASS VALVE FOR SUBMERSIBLE SUCTION CLEANER

[76] Inventor: Pavel Sebor, 45 Highcliff Way, Northcliff Extension 12, Johannesburg, Transvall, South Africa

[21] Appl. No.: 880,667

[22] Filed: May 11, 1992

[30] Foreign Application Priority Data

Feb. 28, 1992 [ZA] South Africa ..... 92/1500

[51] Int. Cl.[5] ..... E04H 4/16

[52] U.S. Cl. ..... 15/1.7; 15/421; 137/526; 137/527

[58] Field of Search ..... 15/1.7, 375, 376, 421; 137/526, 527, 907; 251/337

[56] References Cited

U.S. PATENT DOCUMENTS

| | | | |
|---|---|---|---|
| 1,106,231 | 8/1914 | Marshall | 15/421 |
| 2,096,595 | 10/1937 | Sanford | 15/421 |
| 2,181,594 | 11/1939 | Bjorkman | 15/421 |
| 4,027,695 | 6/1977 | Schnatmeyer et al. | 137/527 |
| 4,275,474 | 6/1981 | Woodard | 15/1.7 |
| 4,692,956 | 9/1987 | Kassis | 15/1.7 |

FOREIGN PATENT DOCUMENTS

| | | | |
|---|---|---|---|
| 806513 | 12/1958 | United Kingdom | 15/421 |
| 875332 | 8/1961 | United Kingdom | 15/421 |

*Primary Examiner*—Harvey C. Hornsby
*Assistant Examiner*—Mark Spisich
*Attorney, Agent, or Firm*—Allen, Dyer, Doppelt, Franjola & Milbrath

[57] ABSTRACT

A by-pass valve is affixed to the housing of a self-propelled submersible swimming pool cleaner. The pool cleaner includes a head having a suction chamber in which a propulsion mechanism is located for operation by water flow into the suction chamber. The head incorporates a by-pass inlet to the suction chamber downstream from the propulsion mechanism. A leaf spring biases the closure member over the by-pass inlet. The tension of the spring is overcome by the suction in the suction chamber when water flow into the chamber is blocked. Water flow is thus allowed into the suction chamber via the by-pass inlet. By placing the spring controlled by-pass inlet into the system flow stream between the cleaner propulsion mechanism and the system weir in the typical pool system, there is a small probability of the by-pass becoming blocked.

4 Claims, 1 Drawing Sheet

INTERNAL BY-PASS VALVE FOR SUBMERSIBLE SUCTION CLEANER

BACKGROUND OF THE INVENTION

1. Field of Invention

This invention relates to self-propelled submersible suction cleaners, particularly swimming submersible pool suction cleaners. The term "self-propelled" herein means that the suction cleaner is not manually propelled but includes means operated by the flow of water through the suction head to cause propulsion of the device.

2. Description of Background Art

Swimming pool suction cleaners often encounter large objects, such as leaves and twigs, which tend to block the flow of water through the cleaner especially at the entrance to the suction chamber of the suction head. In order to avoid the filter pump from becoming starved and the motor suffering damage, the cleaner device is typically provided with a weir by-pass valve at the coupling of the suction hose to the weir intake for the pump. Such weir, however, also collects floating debris and the weir by-pass valve is likely therefore also to be blocked. In such an event the motor for the pump may well burn out.

Furthermore with the weir by-pass valve at the weir, water will tend to flow via that route to the pump since it provides the least resistance to flow. When the flow rate drops due to clogging of the filter or the strainer at the pump, the diversion of flow via the weir by-pass valve at the weir can cause such drive power loss at the cleaner head such that the latter fails to move at all.

SUMMARY OF INVENTION

It is an object of the invention to provide a self-propelled submersible suction cleaner with a by-pass valve which minimizes the above danger.

According to the invention a self-propelled submersible suction cleaner includes a head having a suction chamber in which propulsion means is located for operation by waterflow into the suction chamber, the head incorporating a by-pass inlet to the suction chamber downstream from the propulsion means, a closure member for the inlet, and a spring biasing the closure member to an inlet closing position, the arrangement being one in which the spring is overcome by the suction in the suction chamber when flow into the chamber is blocked, thereby allowing water into the suction chamber via the by-pass inlet.

It will be appreciated that by providing a spring-controlled by-pass inlet into the flow stream between the propulsion means and the weir, and more specifically at the suction chamber, there is a smaller possibility of the by-pass becoming blocked. Furthermore by locating the by-pass valve directly in the suction chamber, immediately downstream of the propulsion means, the diversion of flow via the by-pass valve is limited and the suction cleaner continues to operate efficiently even though the flow rate through the filter system is reduced by clogging.

BRIEF DESCRIPTION OF DRAWINGS

In order to illustrate the invention an example is described below with reference to the accompanying drawings in which.

DETAILED DESCRIPTION OF PREFERRED EMBODIMENT

Figure 1:
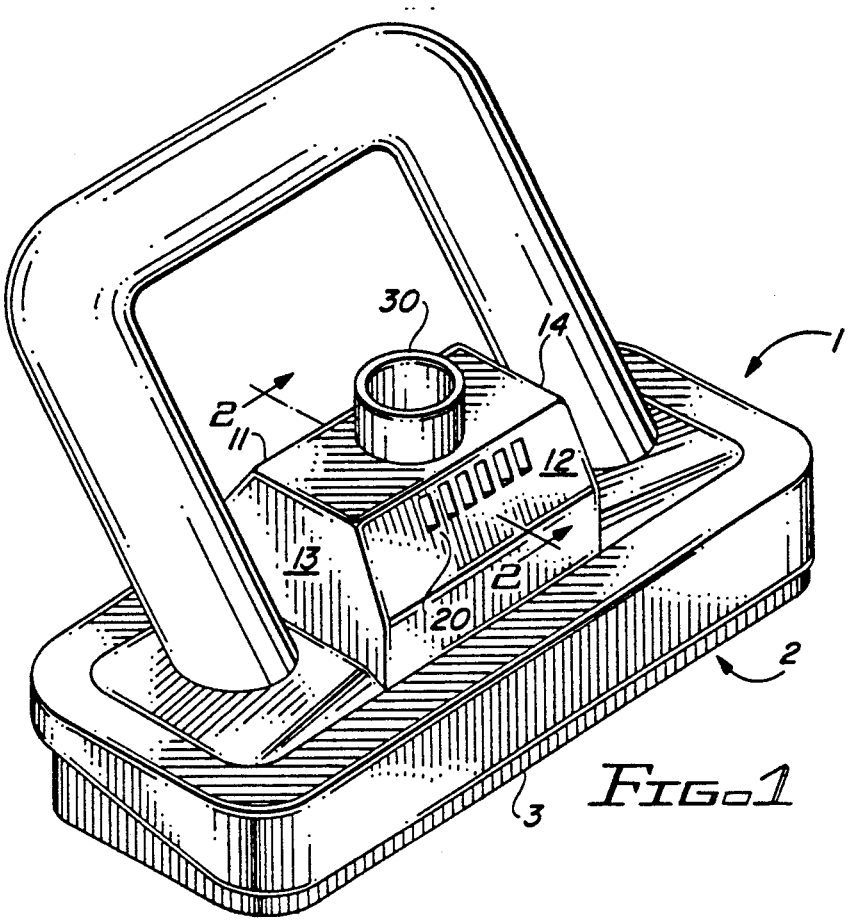
FIG. 1 is a perspective view from the upper side of a self-propelled submersible suction cleaner head according to the invention.
Figure 2:
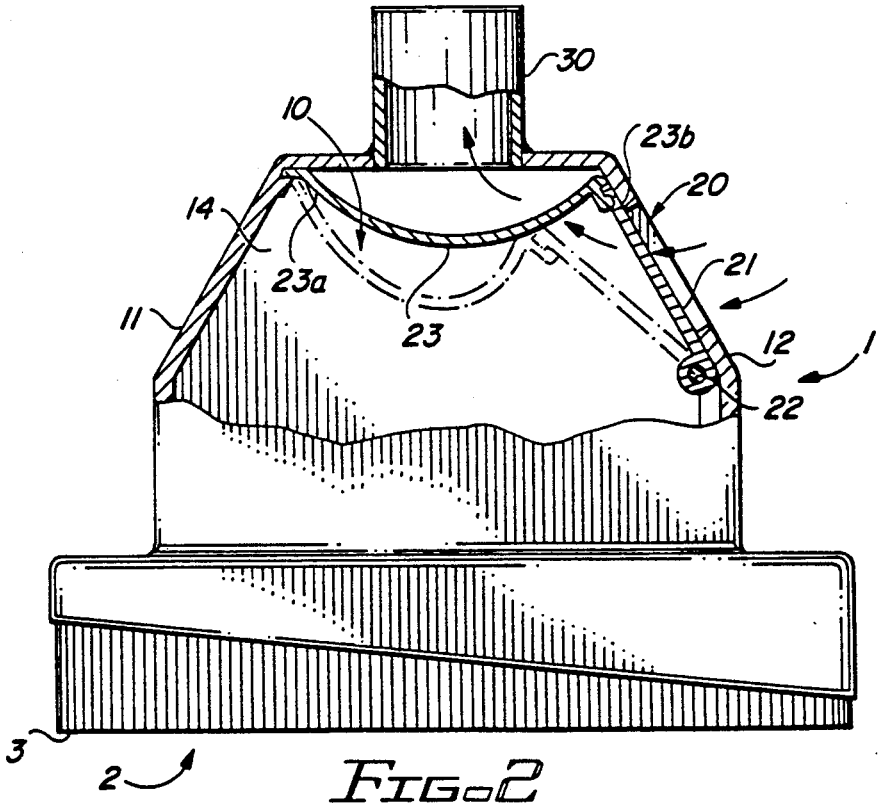
FIG. 2 is a section on the line II—II in FIG. 1.

Referring to the drawings, a self-propelled suction cleaner head comprises a housing 1 having a mouth 2 along which bristles 3 are disposed so that the head rests on the bristles in its operative position.

The head incorporates a suction chamber 10 within the housing 1, which suction chamber is comprised of side walls 11 and 12 and end walls 13 and 14 defining the housing peripheral walls.

An oscillator (not shown) is pivotally mounted within the suction chamber on a hinge pin journalled on side walls 11 and 12 so that the oscillator is located at the entrance to the suction chamber adjacent the mouth 2 of the head.

A connector 30 is provided on the housing 1 for a suction hose (not shown) used to connect the suction head to the filter pump of a swimming pool. Coupling the suction head to the filter pump causes flow into the suction chamber 10 via the mouth 2 of the housing 1 and the flow inpinges first on one side and then on the other side of the oscillator causing the latter to swing to and fro on the hinge pin and to impact against the housing on either side of oscillator which in turn causes the head to advance in stepwise fashion.

It is appreciated that if large objects such as leaves, twigs and the like, collect in restricted areas of the flow path past the oscillator, the flow path could become starved and if no relief or by-pass valve is provided the motor driving the pump will burn out.

In accordance with the present invention the housing 1 includes by-pass apertures 20 in the suction chamber 10 at the upper end thereof close to connector 30 for the suction hoses. These by-pass apertures are closed off by closure plate 21 pivotally mounted within suction chamber 10 on hinge pin 22. Leaf springs 23 are secured at their ends **23*a* on to the housing within the suction chamber 10 and at their opposite ends 23*b* to the closure plate 21. Thus the leaf springs bias closure plate 21 to a position closing by-pass apertures 20**.

With normal operation of the suction cleaner device the restricted passages in the location of the oscillator are unblocked and the springs 23 exert sufficient force to maintain the closure plate 21 in a closed position. However, should the entrance to the suction chamber become blocked with leaves or other debris, the pressure in the suction chamber will drop abnormally. through the action of the filter pump causing the closure plate 21 to be forced away from the by-pass apertures 20 against the biasing action of springs 23. Water will thus flow into the suction chamber and the suction hose via the by-pass apertures 20 until the blockage of the suction chamber is removed. In this way by-pass apertures 20 act as a relief valve ensuring that the pump is not starved and that its motor is not endangered. It will be appreciated that the positioning of the by-pass apertures 20 downstream from the oscillator but away from the weir render it unlikely that the apertures 20 will become blocked. Furthermore it eliminates air suction at the weir when the water level is low.

The strength of springs 23 is balanced to ensure that water is drawn in via the by-pass valve in a controlled way providing regularized speed of the oscillator.

What is claimed is:

1. A self-propelled submersible swimming pool cleaner, comprising:

a housing having peripheral walls, the walls enclosing and defining an internal suction chamber;

connector means extending through the housing for permitting the flow of water from the suction chamber and out of the housing;

a by-pass opening in one of the peripheral walls;

a by-pass closure plate rotatably hinged at one end to the peripheral wall having the by-pass opening therein and movable between a closed position in which water is prevented from flowing through the by-pass opening and an open position in which water flows from the by-pass opening and into the connector means; and a leaf spring attached at one end to an edge of the by-pass closure plate opposite the rotatably hinged end, the leaf spring bridging the suction chamber and attached at the other end thereof to another of the peripheral walls.

2. The submersible swimming pool cleaner recited in claim 1 wherein the by-pass opening comprises plural slots.

3. The submersible swimming pool cleaner recited in claim 1 wherein the closure plate extends across the suction chamber a sufficient dimension such that water flow is only directed toward the connector means.

4. The submersible pool cleaner recited in claim 1 wherein the housing comprises a mouth along which bristles are disposed so that the pool cleaner rests on the bristles in its operative position.

* * * * *

UNITED STATES PATENT AND TRADEMARK OFFICE
Certificate

Patent No. 5,285,547 Patented: February 15, 1994

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Pavel Sebor, Johannesburg, Transvall, South Africa; and Dieter J. Rief, Santa Rosa, CA.

Signed and Sealed this Thirteenth Day of September 2005.

JILL WARDEN
*Supervisory Patent Examiner*
Art Unit 1743